US009068352B2

(12) United States Patent
Thompson

(10) Patent No.: US 9,068,352 B2
(45) Date of Patent: Jun. 30, 2015

(54) FRAMEWORK SERVING AS STRUCTURAL SUPPORT AND UTILITY SPACE

(71) Applicant: J Martin Lovely Thompson, Old Orchard Beach, ME (US)

(72) Inventor: J Martin Lovely Thompson, Old Orchard Beach, ME (US)

( * ) Notice: Subject to any disclaimer, the term of this patent is extended or adjusted under 35 U.S.C. 154(b) by 0 days.

(21) Appl. No.: 14/372,559

(22) PCT Filed: Mar. 20, 2013

(86) PCT No.: PCT/US2013/033084

§ 371 (c)(1),
(2) Date: Jul. 16, 2014

(87) PCT Pub. No.: WO2013/142564

PCT Pub. Date: Sep. 26, 2013

(65) Prior Publication Data

US 2014/0352247 A1 Dec. 4, 2014

Related U.S. Application Data

(60) Provisional application No. 61/613,054, filed on Mar. 20, 2012.

(51) Int. Cl.

| | |
|---|---|
| ***E04H 1/00*** | (2006.01) |
| ***E04C 1/39*** | (2006.01) |
| ***E04B 1/34*** | (2006.01) |
| *E04B 1/348* | (2006.01) |

(52) U.S. Cl.
CPC . *E04C 1/397* (2013.01); *E04B 1/34* (2013.01); *E04B 1/34815* (2013.01)

(58) Field of Classification Search
CPC ..... E04C 1/397; E04B 1/34; E04B 1/34815
USPC ..... 52/79.1, 167.8, 505
See application file for complete search history.

(56) References Cited

U.S. PATENT DOCUMENTS

| | | | | |
|---|---|---|---|---|
| 3,395,502 | A * | 8/1968 | Frey | 52/73 |
| 3,818,654 | A * | 6/1974 | Schramm | 52/79.7 |
| 4,766,708 | A * | 8/1988 | Sing | 52/167.8 |
| 5,007,220 | A * | 4/1991 | Lalvani | 52/653.1 |
| 5,265,395 | A * | 11/1993 | Lalvani | 52/648.1 |
| 5,402,608 | A * | 4/1995 | Chu | 52/79.1 |
| 5,448,868 | A * | 9/1995 | Lalvani | 52/648.1 |
| 5,931,602 | A * | 8/1999 | Gulbrandsen et al. | 405/224 |
| 6,438,906 | B1 * | 8/2002 | Komarowski et al. | 52/169.1 |

(Continued)

FOREIGN PATENT DOCUMENTS

JP 04-357279 A 12/1992

*Primary Examiner* — Basil Katcheves
*Assistant Examiner* — Joshua Ihezie
(74) *Attorney, Agent, or Firm* — Patricia M. Mathers

(57) ABSTRACT

A framework for a building structure. The framework is constructed of two open-walled structures, an inner core structure and an outer core structure. Each core structure is a six-sided cuboid structure formed by hollow horizontal and vertical conduits. The inner core structure is smaller than the outer core structure and interconnecting hollow conduit webs link the two cores. The inner core may be placed on a different horizontal plane than the outer structure, in which case, the interconnecting webs slope from one core to the other one. The conduits of the cores are dimensioned to house utility systems, such as plumbing, wiring, staircases, etc. Walls, windows, doors may be attached to the core structures, to achieve a residential or commercial space suitable for the intended purpose.

5 Claims, 10 Drawing Sheets

(56) References Cited

U.S. PATENT DOCUMENTS

| | | | | |
|---|---|---|---|---|
| 6,748,962 | B2 * | 6/2004 | Miller | 135/130 |
| 6,959,515 | B1 * | 11/2005 | Beighton | 52/79.9 |
| 7,318,303 | B1 * | 1/2008 | Kling | 52/648.1 |
| 7,607,274 | B1 * | 10/2009 | Gillen | 52/745.02 |
| 8,739,477 | B2 * | 6/2014 | Kaiser | 52/167.1 |
| 2006/0070299 | A1 * | 4/2006 | Furumura et al. | 47/69 |
| 2009/0115194 | A1 * | 5/2009 | Lin | 290/55 |
| 2010/0186317 | A1 * | 7/2010 | Kirsten et al. | 52/167.8 |
| 2010/0266841 | A1 * | 10/2010 | Nicholson et al. | 428/355 AC |
| 2010/0287850 | A1 | 11/2010 | Jadhav | |
| 2011/0179741 | A1 * | 7/2011 | Yen | 52/653.1 |
| 2012/0215310 | A1 * | 8/2012 | Sharp et al. | 623/11.11 |
| 2013/0232938 | A1 * | 9/2013 | Roth | 57/258 |
| 2013/0319314 | A1 * | 12/2013 | Wang et al. | 114/265 |
| 2014/0013701 | A1 * | 1/2014 | Rodgers | 52/698 |
| 2014/0224809 | A1 * | 8/2014 | Loukus et al. | 220/501 |

* cited by examiner

FRAMEWORK SERVING AS STRUCTURAL SUPPORT AND UTILITY SPACE

BACKGROUND INFORMATION

1. Field of the Invention

The invention relates to the field of support systems for structures. More particularly, the invention relates to a framework for supporting residential, commercial, industrial and other types of structures, whereby the support system also provides space for utility systems and storage.

2. Discussion of the Prior Art

Most conventional structures, be they for residential, commercial, or industrial endeavors, typically have a load-bearing support system, i.e., a frame, to support the walls and the roof. The utility systems, such as, for example, electrical wiring, plumbing, heating and ventilation, etc., are incorporated into the structure completely independently of the load-bearing support system, and typically in the walls of the structure. The disadvantage of such an arrangement is that it is difficult to access wiring, plumbing, and other systems to replace or repair them, when they are embedded in a wall.

What is needed, therefore, is an integrated structural framework that incorporates space for utility systems into the framework.

BRIEF SUMMARY OF THE INVENTION

The invention is a structure core for providing a load-bearing framework for a structure and, at the same time, providing space for accommodating various infrastructure systems and storage.

The structure core is a dual core system that provides the boundaries for an outer shell of a structure and an inner core for providing access to the infrastructure systems and storage. The term "structure" as used hereinafter shall include any type of a stand-alone structure, such as, but not limited to, residential, commercial, industrials buildings, garages, mobile structures, etc.

The structure core according to the invention has an inner core and an outer core. Each core is a six-sided construction formed by hollow conduits that are interconnected, so as to form an open-body that has an outer shape of a cuboid, whereby the perimeter of the body is defined by the conduits and the body is otherwise open-spaced. The term "cuboid" as used herein encompasses bodies having six faces and wherein the angles between any adjacent faces are right angles.

The conduits are large hollow bodies, dimensioned to accept infrastructure systems, such as, but not limited to, heating, cooling and ventilation systems, oil tank, water heater, electrical and telecommunications wiring, plumbing, storage appliances, such as freezers or refrigerators, and transportation devices and systems, such as ladders, staircases, or elevators. The conduits are preferably dimensioned such that a person can maneuver around inside them. For example, the horizontal conduits may serve as passageways or corridors, the sloping conduits as stairwells, and the vertical conduits may accommodate an elevator or ladder well. Storage shelves or platforms may be affixed to the inner walls of the conduits. The dimensions may be such that a large piece of furniture may be stored in the conduit, with space remaining for a passageway. The interconnected system of conduits allows wiring, plumbing, heating and ventilation means to be re-configured with regard to various areas of the structure, without having to break through walls and floors. This concept allows appliances and systems to be placed close to where they are needed. The water tank, for example, may be placed in a conduit close to the kitchen and or bathroom.

Exterior wall, doors, windows, roofs may be incorporated into or affixed to the outer core, and interior floors and walls affixed to the inner core and outer core.

The structure core may be partially submerged in the ground, so that underground utilities enter into the respective conduits below grade.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

Figure 1:
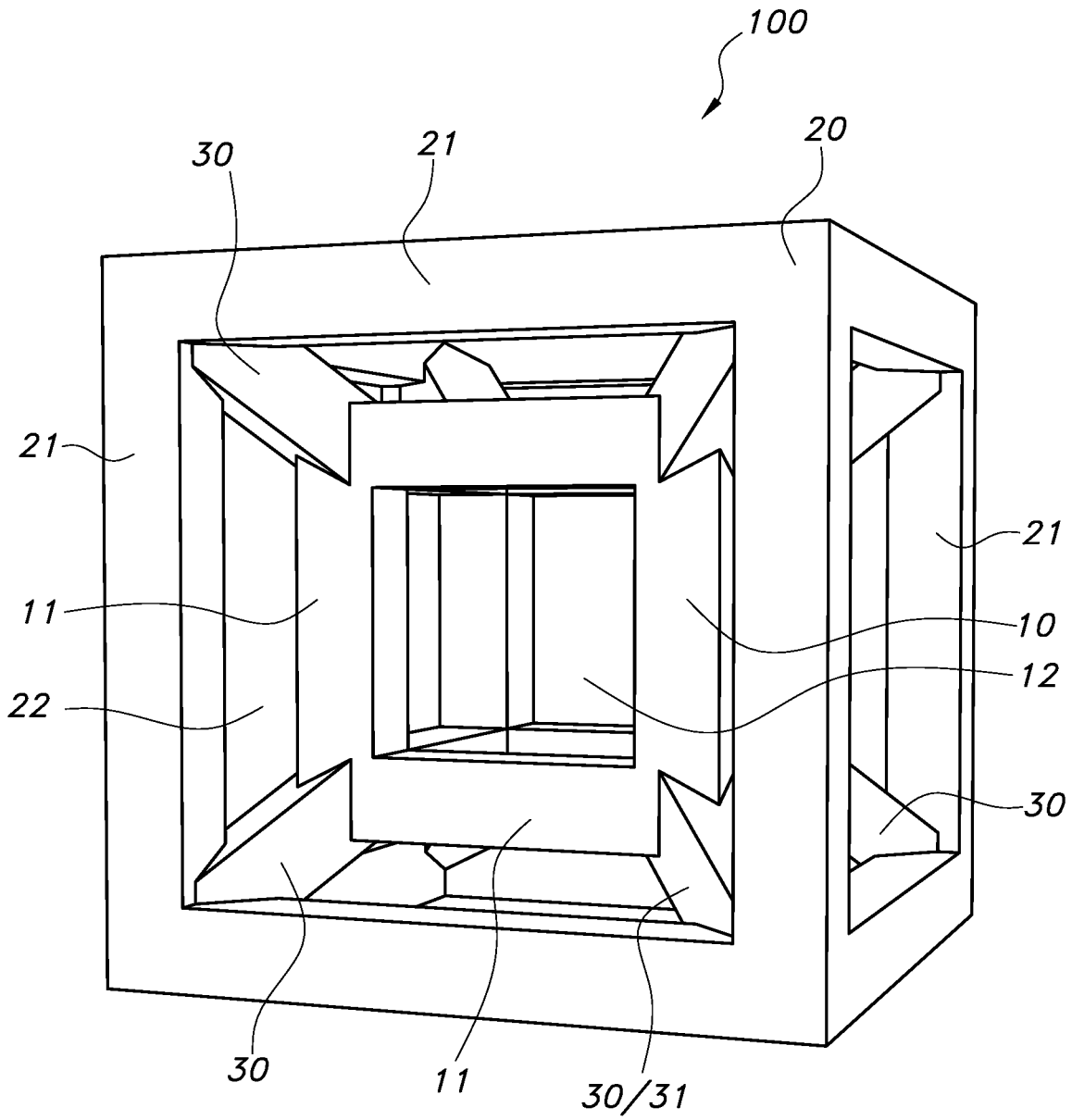
FIG. 1 is a perspective view of a structure core according to the invention.
Figure 2:
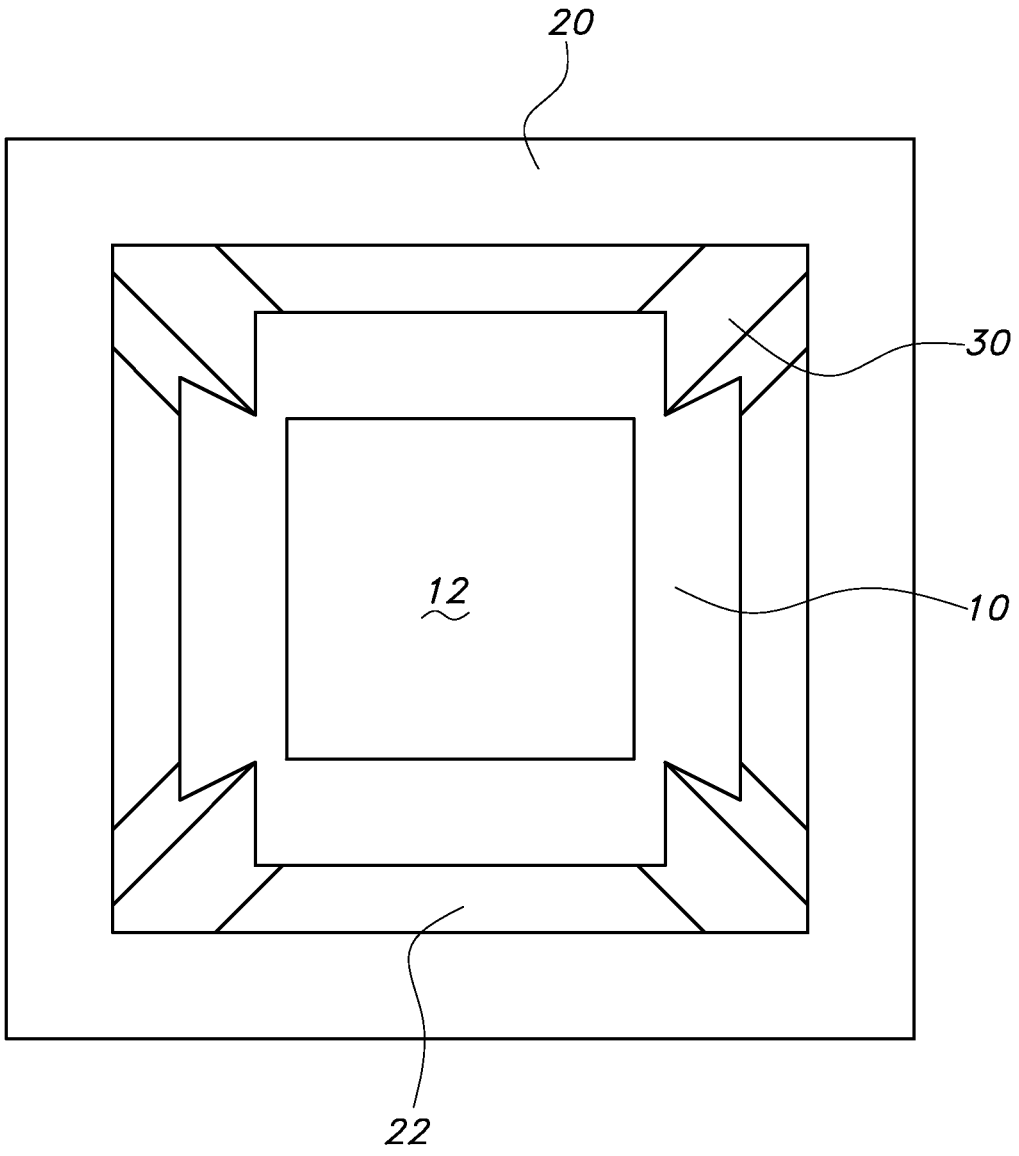
FIG. 2 is a front plan view of the structure core.
Figure 3:
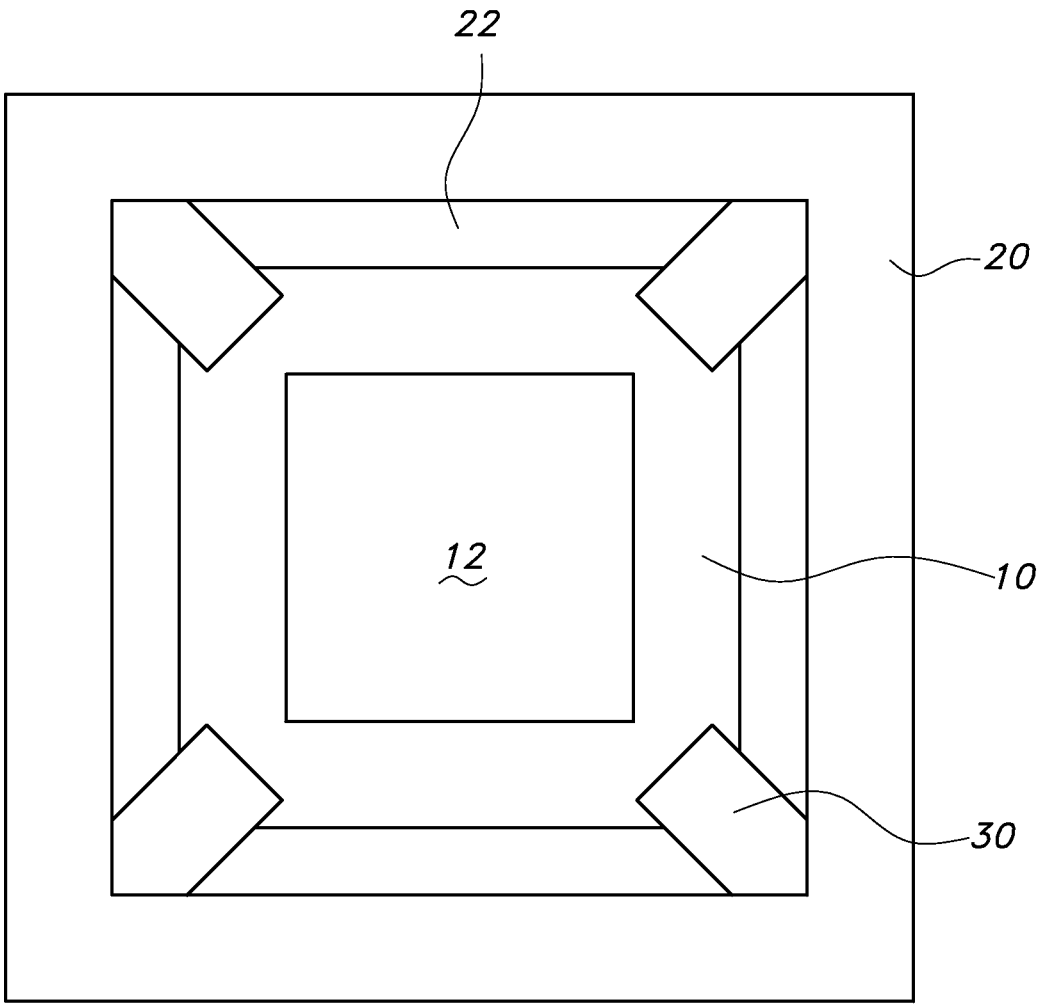
FIG. 3 is a top plan view of the structure core.
Figure 4:
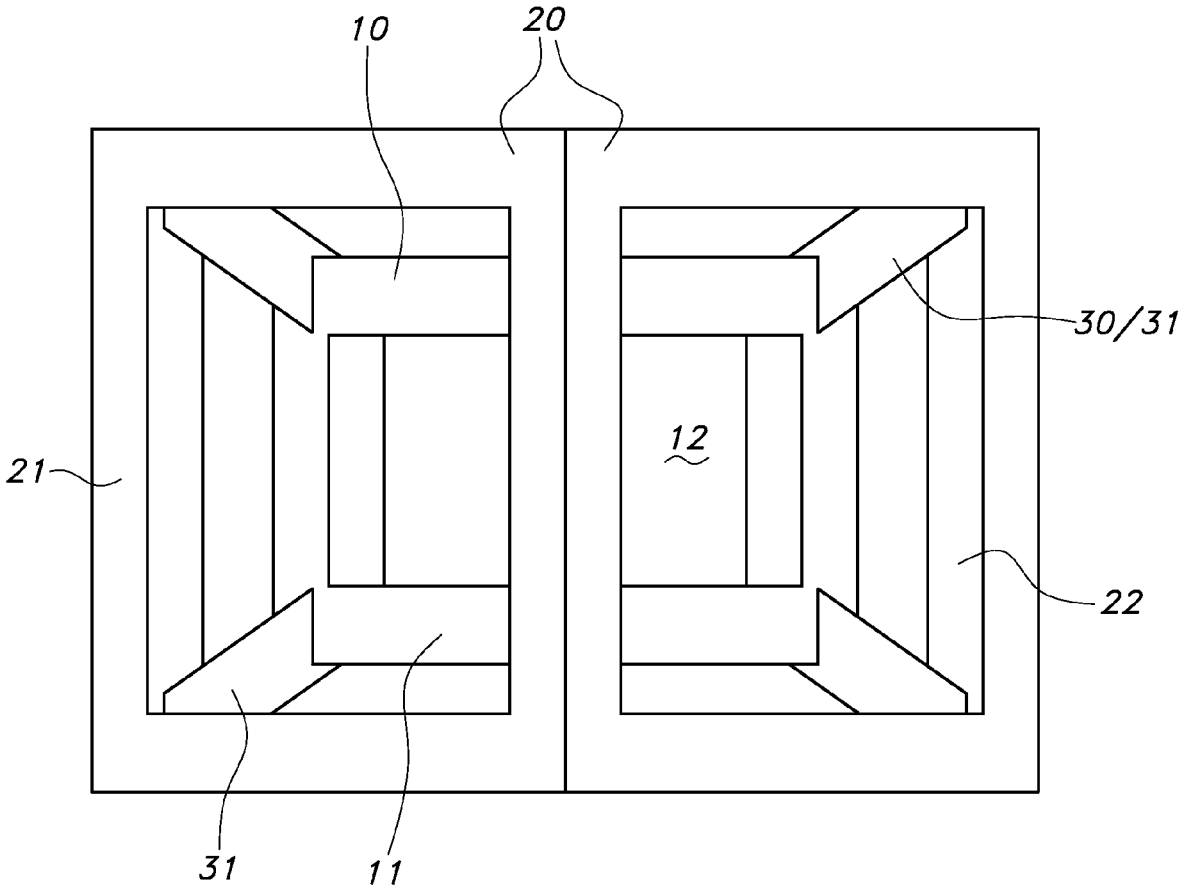
FIG. 4 is an elevation plan view of the structure core, looking straight on at a corner of the core.
Figure 5:
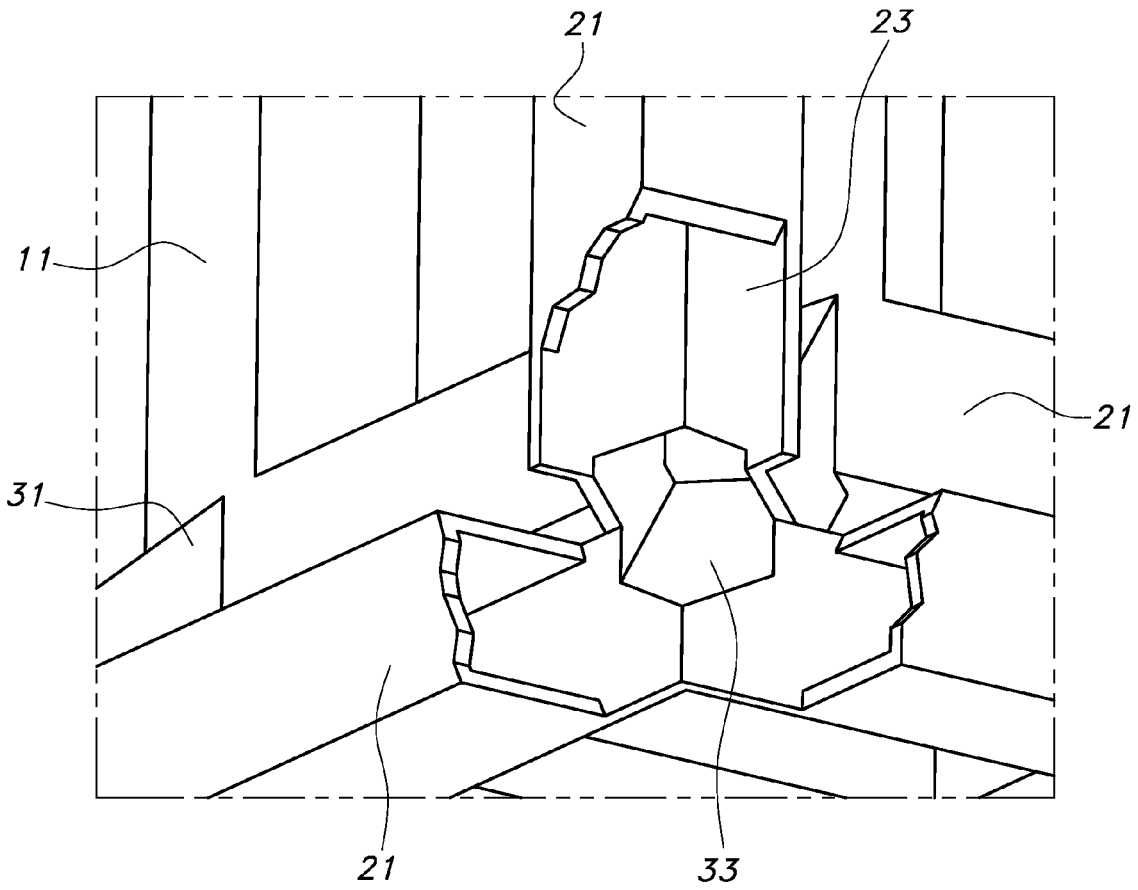
FIG. 5 is a partial cut-away view of intersecting core conduits.

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

FIGS. 1-7 and 9A-9B illustrate a structure core 100 according to the invention. The purpose of the structure core 100 is to provide a load-bearing framework for a structure, for example, a residential, commercial, or industrial building, whereby the framework also provides readily accessible internal space for carrying or storing various utilitarian systems of the structure. The structure core 100 comprises an inner core 10 and an outer core 20. The boundaries of each core 10, 20 are defined by core conduits 11, 21, respectively, that are interconnected within each core to form an outer shape of a square or a rectangular prism, i.e., a cube or a cuboid. Each of the six sides of each core 10, 20, has an open space 12, 22, respectively, bounded by the inner perimeter of the conduits 11 and 21. The inner and outer cores 10, 20 are connected to each other by an interconnecting web system 30 which includes sloping conduits 31 that extend through the open spaces 22 of the outer core 20 and provide a transition from the level of the outer core 20 to the level of the inner core 10.

FIGS. 5 and 9A-10B are partial cut-away views of the structure core 100 that illustrate the core conduits 11, 21, and 31. FIG. 9B illustrates particularly well how the conduits intersect and provide a continuous passageway. Each conduit 11, 21, or 31 provides an interior space 13, 23, 33, respectively, that is in communication with the interior space of an adjacent conduit. Thus, for example, all wiring and plumbing may be run inside the conduits, and access to the particular system provided at an access point on one or more of the conduits 11, 21, or 31 at a convenient location.

The dimensions of the conduits 11, 21, and 31 depend, of course, on the intended use of the structure to be built around the structure core 100. In a residential structure, for example, the conduits are dimensioned so as to accommodate heating, cooling, electrical, plumbing, and other utility systems, as well as a staircase or an elevator and storage space. In an embodiment for a residential structure, the conduits 11, 21, and 31 may be constructed of concrete and have an inner dimension of 2×2 meters or 7×7 feet, or any other dimension that is suitable. These suggested dimensions are large enough to accommodate most heating, air conditioning, ventilation, refrigeration, vacuuming appliances, etc., and still provide passage around them or room for a ladder or small staircase.

Figure 6:
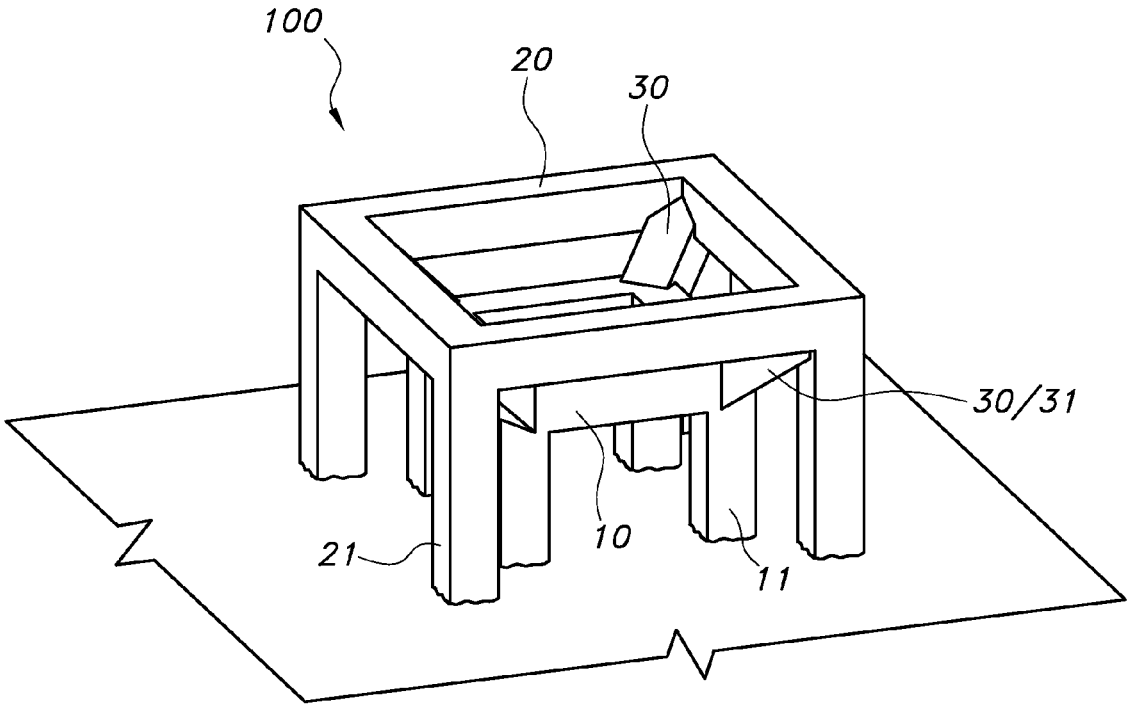
FIG. 6 shows a prototype of the structure core partially submerged in the ground.

FIG. 6 illustrates the structure core 100 with the lower boundary of the outer core 20 buried in the ground. When used for a residential, commercial, or industrial building, for example, a lower portion of the structure core 100 is preferably placed below grade, so that underground utilities feed into the appropriate conduits below grade.

Figure 7:
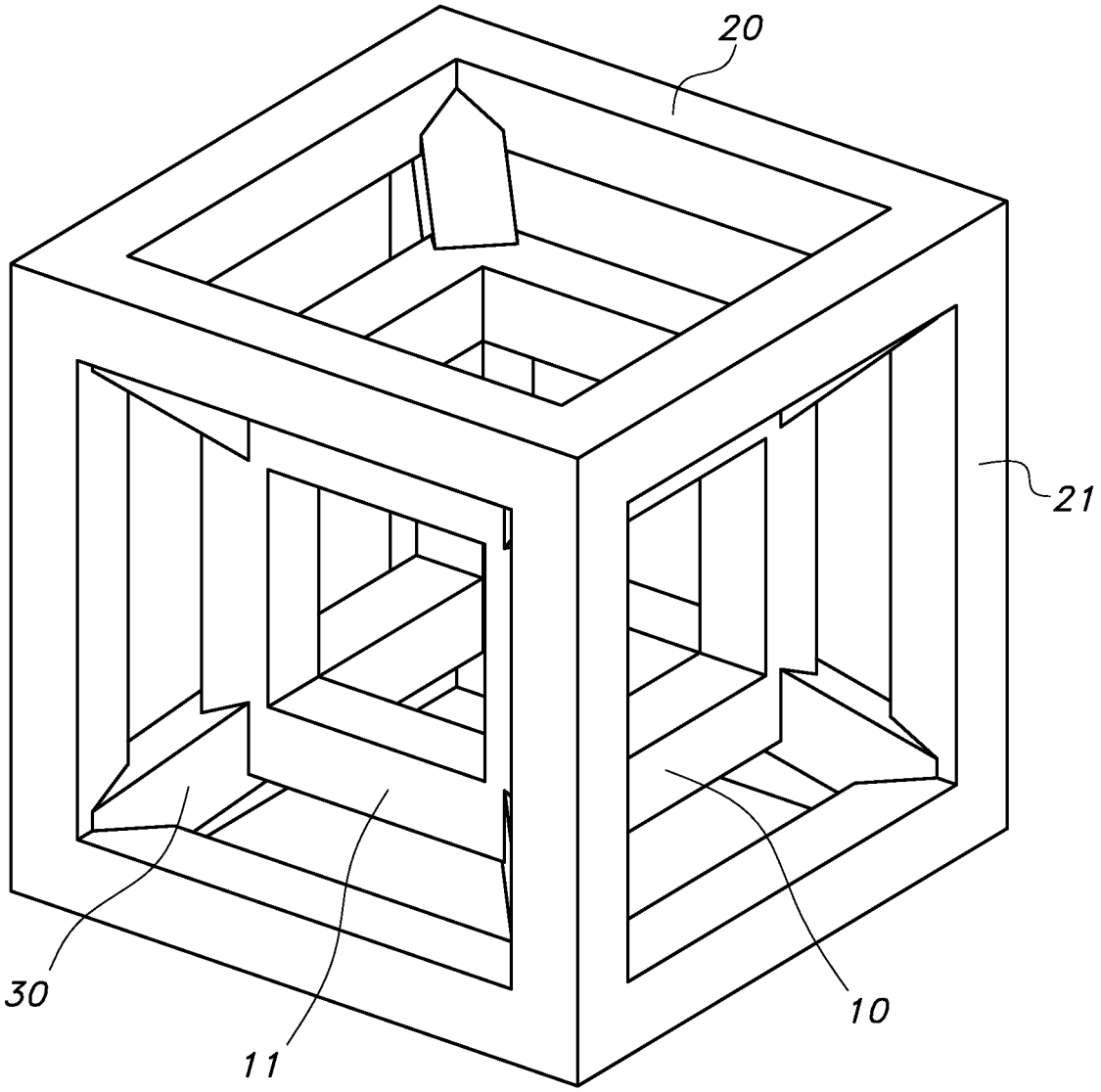
FIG. 7 is a prototype of the structure core.

FIG. 7 is a top perspective view of the structure core 100 shown in FIG. 1. The prototype of this structure core was constructed of steel, but, as mentioned above, concrete or reinforced concrete is more likely the material to be used for the structure core. The choice of material will depend, of course, on the intended purpose of the structure.

The figures provided herein illustrate a dual core support structure 100 in which the inner core 10 is supported within the boundaries of the outer core 20, such that an elevation means, such as a ramp, a ladder, a staircase, is required to move from a level defined by a horizontal conduit 21 to a level defined by a horizontal conduit 11. This variation in levels is desirable in buildings in which it is useful or convenient to have a basement level and an attic level.

Figure 8A:
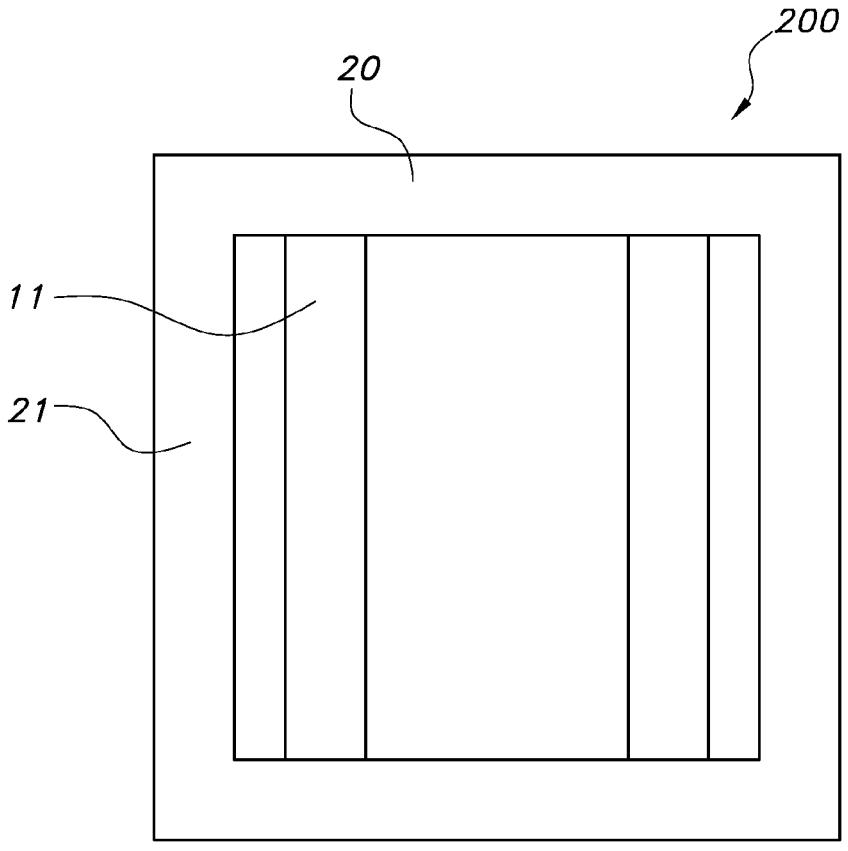
FIG. 8A is a top plan view of a second embodiment of the structure core according to the invention.
Figure 8B:
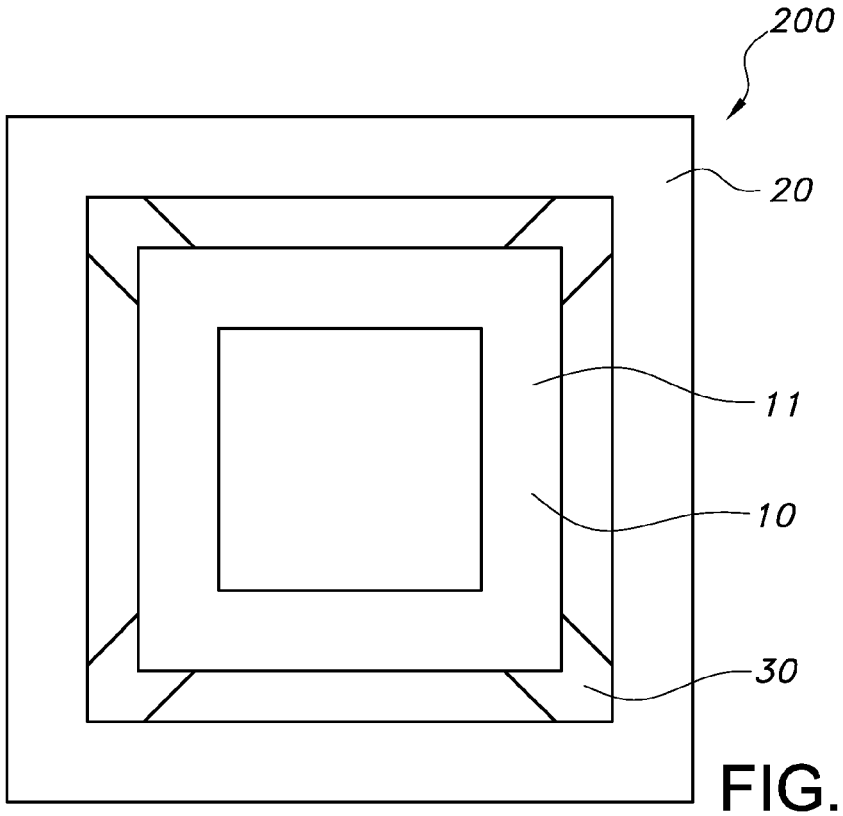
FIG. 8B is an elevation view of the second embodiment.
Figure 9A:
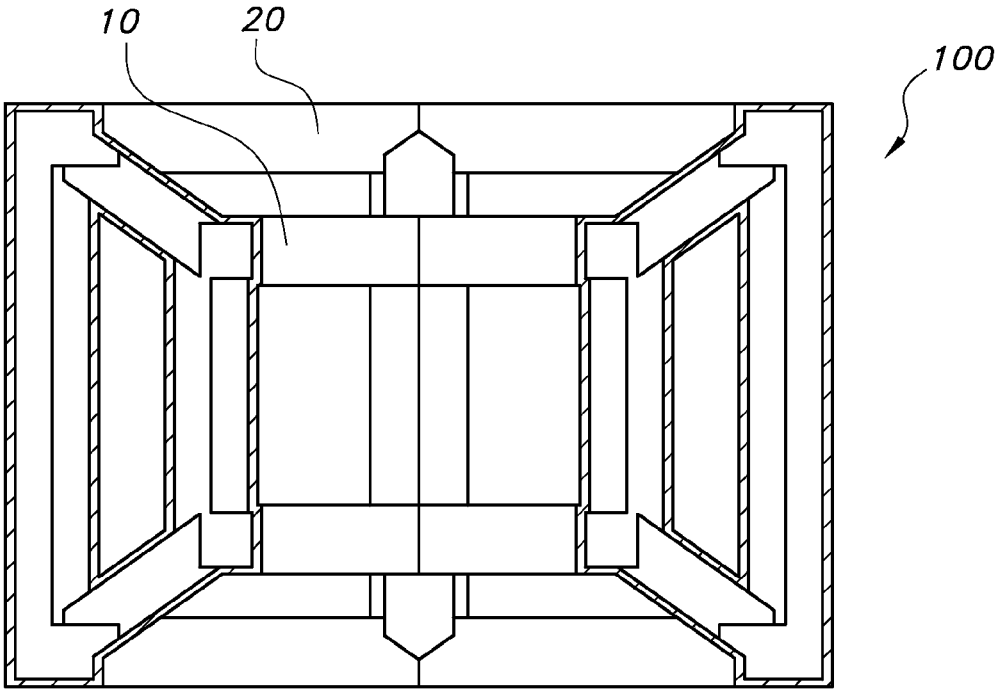
FIG. 9A is a plan cross-sectional view, cut diagonally across the structure core.
Figure 9B:
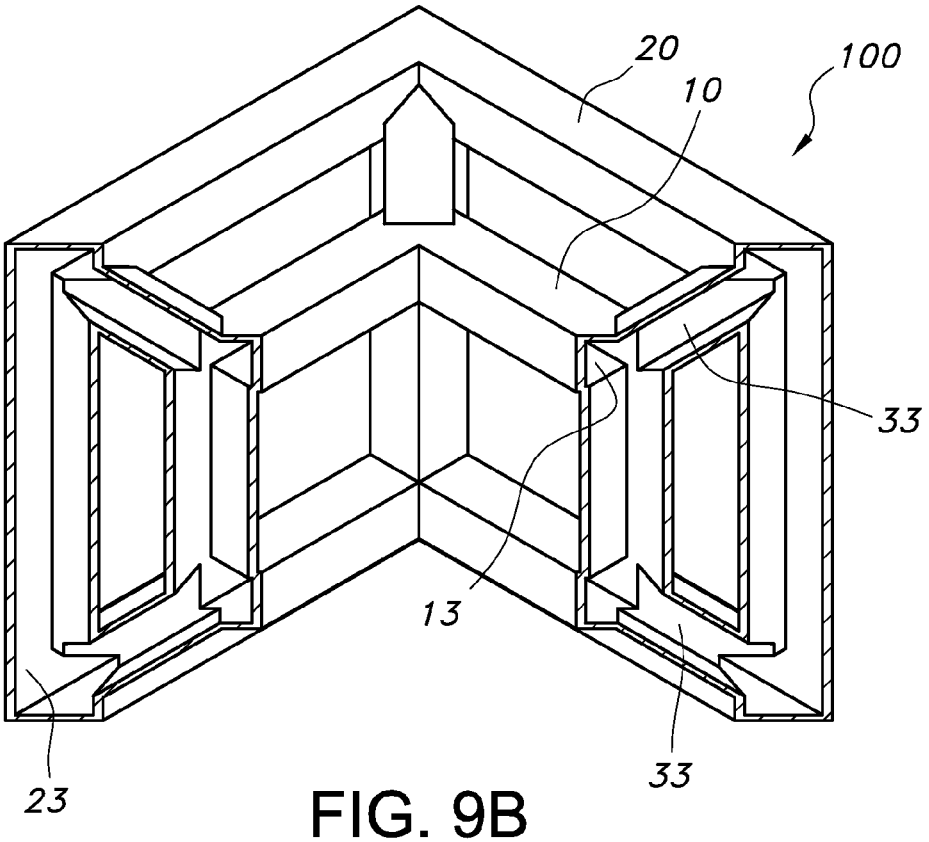
FIG. 9B is an isometric view of FIG. 9A.
Figure 10A:
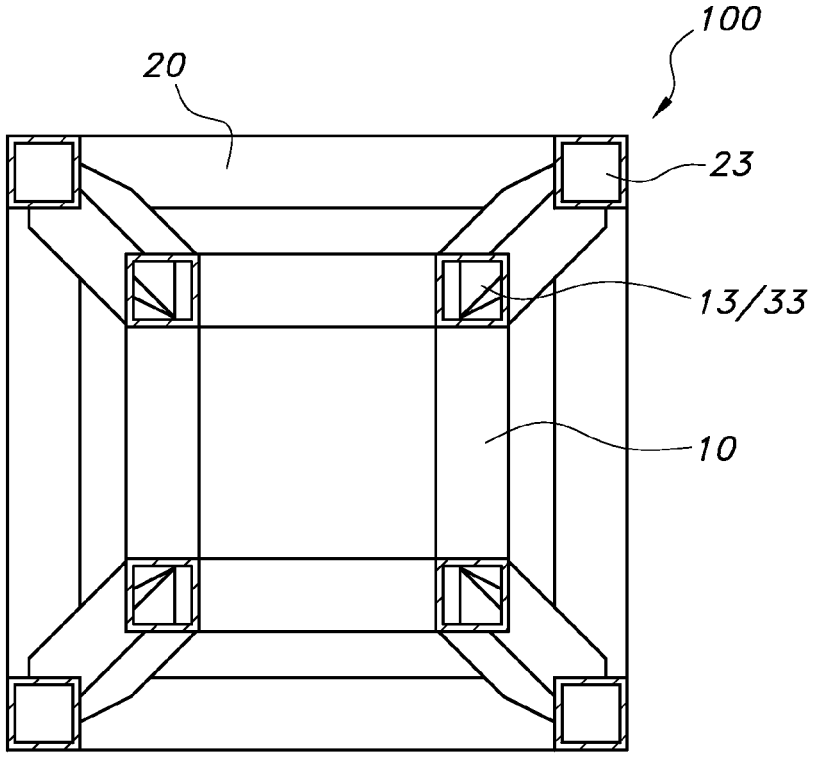
FIG. 10A is a view across the top of the structure, showing open-ended conduits.
Figure 10B:
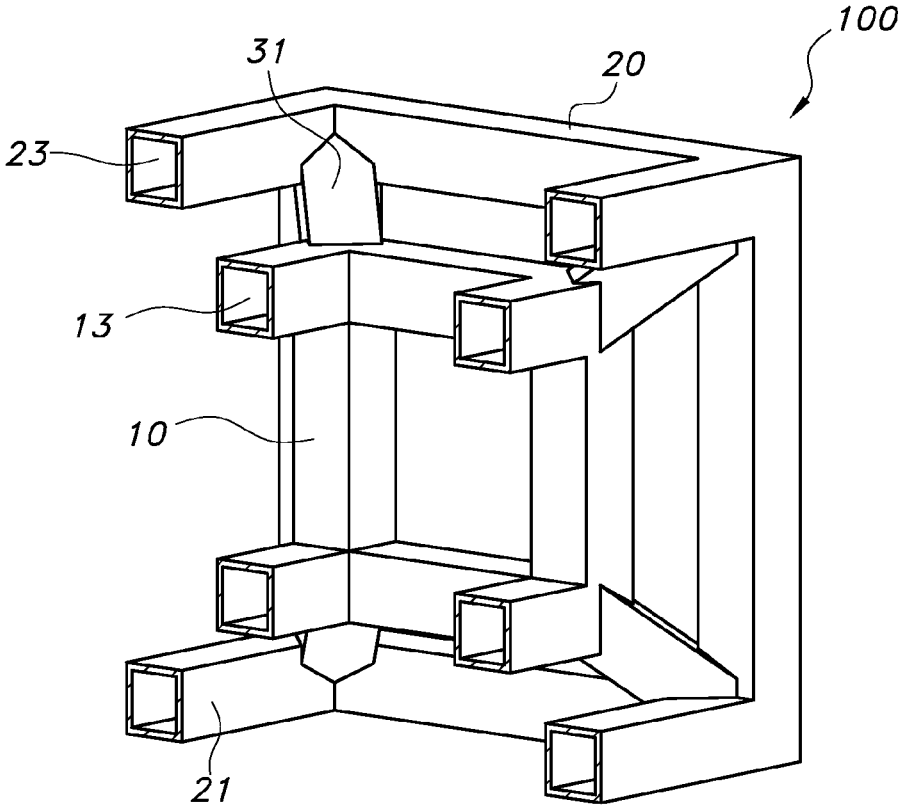
FIG. 10B is an isometric view of FIG. 10A.

FIGS. 8A and 8A illustrate a second embodiment of the dual-core support structure 200 in which the height dimension of the inner core 10 and the outer core 20 are the same. In some cases, it may not be necessary to have various levels within the structure, but rather, to have a simpler structure that has a single lower boundary and a single upper boundary that are defined by both cores. In this case, the connecting conduits 31 are horizontal, rather than sloping.

Exterior walls, doors, windows, and a roof may be attached to the outer core 20 and interior walls attached to the inner core 10 and between the inner and outer cores.

Depending on the materials used for the walls and roof, it is possible to construct a building with the structure core 100 according to the invention, in which a person standing in the inner core has an unimpeded view to the outdoors, through all side walls and through the roof. For example, if a transparent material is used for at least the center portion of the roof that covers the upper face of the inner core 10 and for at least portions of the exterior walls, the structure so constructed would significantly reduce the need for lighting, because of the ambient light coming through the transparent material.

It is understood that the embodiments described herein are merely illustrative of the present invention. Variations in the construction of the structure core may be contemplated by one skilled in the art without limiting the intended scope of the invention herein disclosed and as defined by the following claims.

What is claimed is:

1. A dual-core support structure for a free-standing structure, the dual-core support structure comprising:

an inner core;

an outer core; and interconnecting conduits;

wherein each core is constructed with vertical and horizontal core conduits that are interconnected with each other, so as to form an open six-sided body that has an outer shape of a cuboid;

wherein the inner core fits within the outer core and the interconnecting conduits connect the core conduits of the inner core with the core conduits of the outer core;

wherein the core conduits and the interconnecting conduits are hollow; and wherein, the outer core defines an outer boundary and the inner core an inner boundary, and wherein the inner core is smaller in size than the outer core and fits within the outer core, such that horizontal and vertical planes of the inner boundary are smaller than and parallel to horizontal and vertical planes of the outer boundary and the interconnecting conduits slope from the outer core to the inner core.

2. The dual-core support structure of claim 1, wherein the outer core defines an outer boundary and the inner core defines an inner boundary, and wherein the horizontal conduits of the inner boundary are smaller than the horizontal conduits of the outer boundary, such that, the inner core fits within the outer core and the interconnecting conduits between the outer core and the inner core are on a horizontal plane.

3. The dual-core support structure of claim 1, wherein the core conduits are dimensioned so as to accommodate utility systems.

4. The dual-core support structure of claim 1, wherein one or more of the vertical core conduits are dimensioned to accommodate a staircase.

5. The dual-core support structure of claim 1, wherein the inner and outer cores are constructed of reinforced concrete.

* * * * *